United States Patent [19]

Wright

[11] Patent Number: 4,688,796

[45] Date of Patent: Aug. 25, 1987

[54] AIMING SYSTEM FOR BILLIARDS

[76] Inventor: Fred Wright, 4575 Falkirk Bay, Oxnard, Calif. 93030

[21] Appl. No.: 786,349

[22] Filed: Oct. 10, 1985

Related U.S. Application Data

[63] Continuation-in-part of Ser. No. 554,271, Nov. 22, 1983, abandoned.

[51] Int. Cl.[4] ..... A63D 15/08

[52] U.S. Cl. ..... 273/68; 362/109; 362/102; 273/14

[58] Field of Search ..... 273/14, 9, 8, 3 R, 68; 362/32, 102, 109, 120

[56] References Cited

U.S. PATENT DOCUMENTS

| | | | |
|---|---|---|---|
| 1,297,815 | 3/1919 | Englehart | 273/3 R |
| 2,080,608 | 5/1937 | Hannaford | 362/102 |
| 2,257,227 | 9/1941 | Datar | 362/102 |
| 2,260,639 | 10/1941 | Powell | 362/102 |
| 2,813,968 | 11/1957 | Wood, Jr. | 56/322 |
| 3,389,911 | 6/1968 | Castiglione, Jr. | 48/80 |
| 3,411,779 | 11/1968 | McGowan | 128/303.1 |
| 3,711,091 | 1/1973 | Dixon | 15/90 |
| 3,917,264 | 11/1975 | Davidson et al. | 2/230 |
| 3,993,305 | 11/1976 | Nicholson | 238/42 |
| 4,027,883 | 6/1977 | Barton | 273/14 |
| 4,082,270 | 4/1978 | Josenhans | 273/2 |
| 4,460,940 | 7/1984 | Mori | 362/32 |

FOREIGN PATENT DOCUMENTS

| | | | |
|---|---|---|---|
| 1656 | 1/1907 | United Kingdom | 273/68 |

*Primary Examiner*—Richard C. Pinkham
*Assistant Examiner*—T. Brown
*Attorney, Agent, or Firm*—Marvin E. Jacobs

[57] ABSTRACT

An aiming system for billiards and like games wherein a cue is provided with a switch-actuateable generator for causing a narrow collimated beam of light to emerge from the playing tip along the longitudinal axis of the cue. In the preferred embodiment, a laser generator is positioned within the handle portion of the cue and the light therefrom moves through a longitudinal bore along the length of the cue to emerge from an apertured standard playing tip. A billiard table is also disclosed containing a set of reflector elements mounted vertically within the overhang of the edge cushions of the table.

5 Claims, 9 Drawing Figures

AIMING SYSTEM FOR BILLIARDS

This application is a continuation-in-part of application Ser. No. 554,271, filed Nov. 22, 1983 (abandoned).

TECHNICAL FIELD

The present invention relates to an aiming system for use in playing the game of billiards, including the game of pocket billiards. More particularly, this invention relates to a pool cue modified to contain a beam generation means and a pool table containing reflector display means to aid the player in determining whether the pool cue is disposed at a proper position and angle.

DESCRIPTION OF THE PRIOR ART

Aiming is required in every shot in billiards or pocket billiards. In pocket billiards, the cue propels the cue ball at a first target ball in order to direct the target ball in a certain path either directly or indirectly toward a pocket while trying to avoid scratching, i.e. entry of the cue ball into a pocket. The trajectory of the target ball and the cue ball are both controlled by the manner in which the cue stick contacts the cue ball. The spot at which the cue stick hits the cue ball determines its spin during and after contact with the target ball. For example, if the point of the cue stick contacts the cue ball below its mid point, reverse spin is applied to the cue ball and it will tend to return toward the cue stick after contacting the target ball.

Conversely, if the spot at which the cue stick contacts the cue ball is above and mid point of the sphere, forward spin is applied to the ball and it will tend to follow the target ball after contact therewith. Similarly, right-hand and left-hand spin can then be applied to the cue ball by choosing a contact spot to the left or the right of a vertical plane through the mid-point of the cue ball.

It is very rare to find any play situation in which the pocket, target ball and cue ball are all positioned in a straight line. This is the simplest aiming combination in which the player attempts to propel the cue ball in a straight line at the target ball which after impact rolls in a straight line into the pocket. In all other cases, the cue ball and target ball are out-of-line and the target ball must be contacted with the cue ball from a very acute angle on one edge of the target ball to a very acute angle on the other edge to propel the target ball over almost 180° of different lines of motion.

Another necessary skill that is common to both billiards and pocket billiards is the design and execution of banking shots. Banking requires traverse of the cue ball and/or target ball against at least one cushion before the ball comes to rest or enters a pocket. Many times the ball will contact three or four cushions and each time at a different angle. These shots are very hard to plan and to aim, especially if the table is crowded with many balls as it is at the start of a rack.

Another way to estimate the pattern of travel of a ball during banking is to use diamond shaped marks spaced along the table rail behind the cushions and mentally project the point of contact of the ball between adjacent diamonds. Of course, a mechanical, mathematical device such as a protractor could be used to estimate or calculate the angle of travel.

A problem in aiming is that the player is positioned a substantial distance behind the cue ball and is sighting along a long cylindrical surface toward a spherical surface. It is difficult to align the cylindrical cue stick with the spherical cue ball, since there are no sharp points or edges for sighting. Secondly, the pointer spot of contact is usually hidden or obliterated by the cue stick itself.

The problem of improving the aim of a pool cue has been addressed by several inventors, but each provided a different implementation. McGowen (U.S. Pat. No. 3,411,779) discloses a removable sighting and aiming device. Dixon (U.S. Pat. No. 3,711,091) illustrates a cue ball director which is a visual aiming device containing a pointer and an imitation cue ball. In U.S. Pat. No. 3,917,264 to Davidson, et al., the billiard balls and cue tip are coated with a fluorescent coating and a black ultraviolet light is applied to the surface. Nicholson (U.S. Pat. No. 3,993,305) segments the training ball to aid in sighting. Josenhans (U.S. Pat. No. 4,082,270) discloses a set of cue pointers which are used to estimate banking angles. Another instance of a sighting device mounted on a cue stick is shown in Castiglione, Jr. (U.S. Pat. No. 3,389,911). An aiming light is disclosed in the illuminated screw driver of Ford, Jr. (U.S. Pat. No. 2,813,968). However, the light source is contained in the handle rather than the tip.

The prior aiming devices require separate apparatus such as sighting or aiming implements which are attached to the cue stick or special non-regulation cue balls which can only be used for training and not during regulation play. The Davidson system requires specially prepared billiard balls and cue tips that can only be used in the presence of a particular lighting system.

STATEMENT OF THE INVENTION

The billiard aiming system of the invention includes a cue stick that can be used as a training device or can be utilized as the regulation cue for play on a regulation table. The system gives an exact aiming spot for contact of the cue tip with the cue ball and when combined with a modified, reflectorized cushioning system can also provide a banking pattern before a shot is attempted.

The aiming system of the invention includes a cue containing an aiming light mounted in the tip that directs a narrow, collimated beam of light from an aperture toward and onto the cue ball. The player can direct his aim right or left and/or up or down for spin or English.

The spot of light on the cue ball is moved until the cue is in proper position for a shot. Another and perhaps more important aiming requirement is to assure that the cue ball is directed in the correct path and impacts the target ball at the correct spot. The cue of the invention can be used to assure the cue is properly positioned by raising the bridge or the sighting hand to elevate the cue stick over the cue ball. The rear hand holding the handle will also be elevated. The light is beamed until the desired spot on the target ball is illuminated. The cue is then lowered and the light beamed onto the desired spot on the cue ball. The shot is then executed.

The cue can also be utilized in conjunction with reflectorized strips mounted in the cavity below the bumpers. When the narrow collimated beam is directed towards one of the strips, a trajectory path is illuminated showing whether the ball would follow a certain path and come to rest or enter a desired pocket following the trajectory.

The aiming system of the invention is simple, reliable and compact and does not contain any moving parts. The pool cue can be utilized on any conventional regulation pool or billiard table and the only replaceable, disposable parts are the light bulb and battery which power the aiming light. The apparatus does not interfere with play nor involve modification of the table. The reflectorized strips can be made so that they are portable and can be applied or removed from regulation tables. The aiming system of the invention will be useful in training novices in the game or increasing the accuracy and skill of the experienced pool players.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
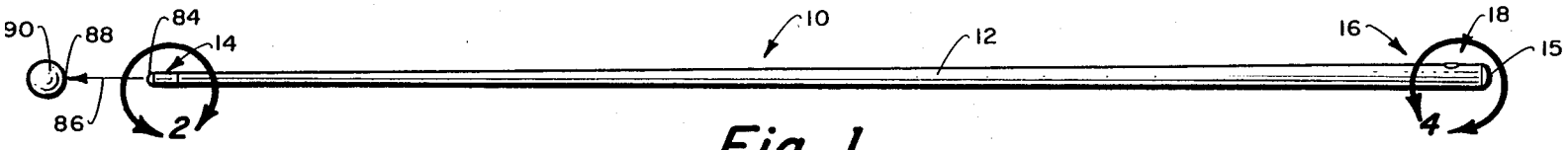
FIG. 1 is a view in elevation of a pool cue in accordance with a first embodiment of the present invention.
Figure 3:
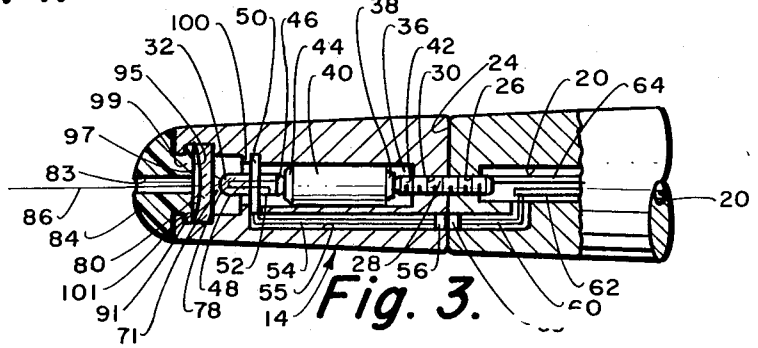
FIG. 3 is a view in section taken along the line 3—3 of FIG. 2.

Referring now to FIGS. 1–4, a pool cue 10 is composed of a central shaft portion 12, a removable tip portion 14 containing an aiming light and a handle portion 16 containing a switch 18 for actuating the light. The shaft 12 usually has a cylindrical crosssection which gently tapers from the handle 16 toward a tip portion 14. A resilient bumper 15 can be removably attached to the handle end of the cue. A central bore 20 is provided in the shaft 12 extending from the switch mechanism 18 up to the forward end 24 of the shaft where it communicates with a threaded opening 26 which receives a threaded stud 28. The stud 28 is also received into a threaded bore 30 in the rearward end of the tip portion 14. The threaded stud 28 can also serve as one electrical connector for the aiming light 32. The stud 28 extends into the battery compartment 36 and contacts the lower terminal base 38 of the battery 40. A spring, not shown, may be mounted over the upper end 42 of the stud to provide a resilient force on the battery 40.

The upper terminal 44 of the battery is biased into contact with the central terminal 46 of the bulb 48. A conductive bulb holder 50 contacts the brass base 52 of the bulb which serves as the second terminal. A conductive element 54 connects the sleeve 55 to a male connector 56 provided at the base of the tip portion 14. The terminal 56 is placed into abutting contact with a female connector 58 provided on the upper end of the shaft 12 when the tip is assembled to the shaft. The connector 58 is connected by means of a conductive element 60 to one of the wires 62 extending through bore 20. The other wire 64 in the bore 20 connects the conductive threaded stud 28 to a contact plate 68 in the switch mechanism 18. Conductor 62 connects to another plate 70.

A button member 72 is retained in bore 73 by means of a snap ring 74. When the button 72 is depressed, plates 68 and 70 come in contact completing a series circuit through the battery and filament 78 of the bulb 48 and creating a beam 71 of light. The beam 71 is collimated by means of lens 80 and the beam passes through a cylindrical opening 83 in the resilient tip member 84 as a highly collimated, narrow directional beam 86 which is directed onto a spot 88 on a cue ball 90 or other billiard ball or pool ball.

The aiming light is assembled in the tip 14 by first inserting the battery 40 into the compartment 36 and snapping the collar 50 containing the bulb 48 past the tigs 100. The lens 80 is then placed in the larger cavity formed between the boss member 91 and the inner surface 95 of the circular extension 97. The resilient, apertured tip 84 having a collar 99 terminating in a wider ring extension 101 is then press fit into engagement with the edge of the lens to retain the lens in place.

The threaded stud 28 is then rotated clockwise until the battery 40 is firmly in contact with the bulb 48. The shaft 12 is then threaded onto the stud 28 until the tip 14 and the shaft are firmly in engagement and connector 56 and 58 are engaged in firm electrical contact. On pressing of the button 72, plates 68 and 70 engage to close the circuit. A collimated light beam 86 projects onto the spot 88 on the ball 90.

Figure 6:
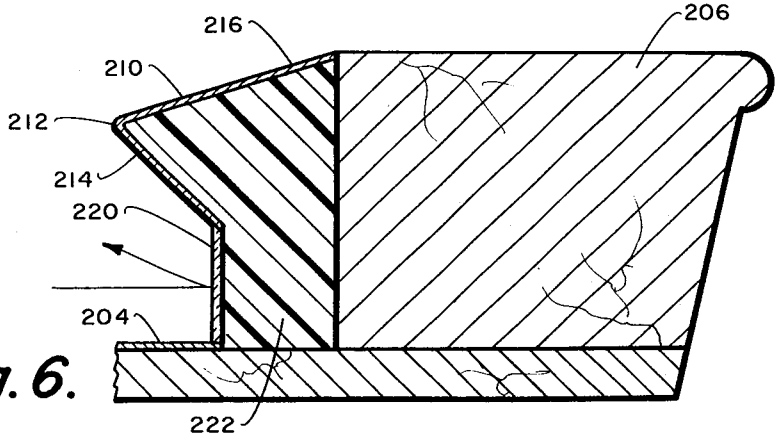
FIG. 6 is a view in section taken along the line 6—6 of FIG. 5 showing the aiming system of the present invention incorporated therein.
Figure 2:
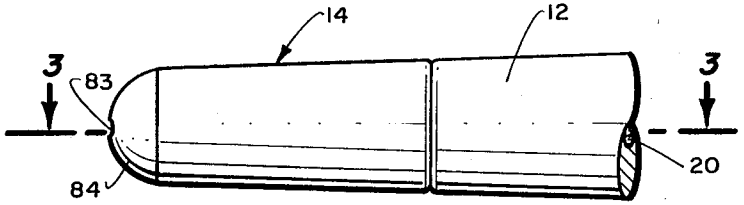
FIG. 2 is an enlarged detail in elevation of the tip of the pool cue of FIG. 1 taken along line 2.
Figure 4:
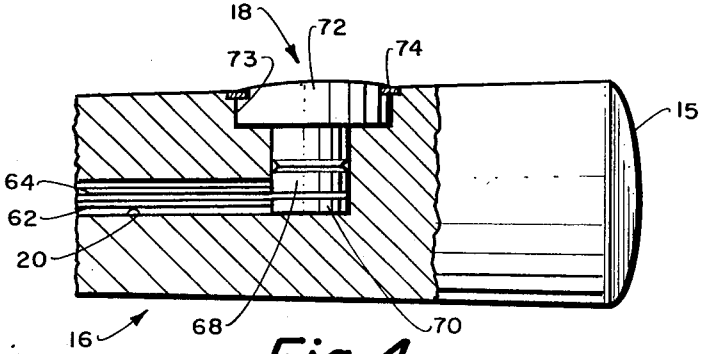
FIG. 4 is an enlarged view partially in section taken along the line 4 of FIG. 1.
Figure 5:
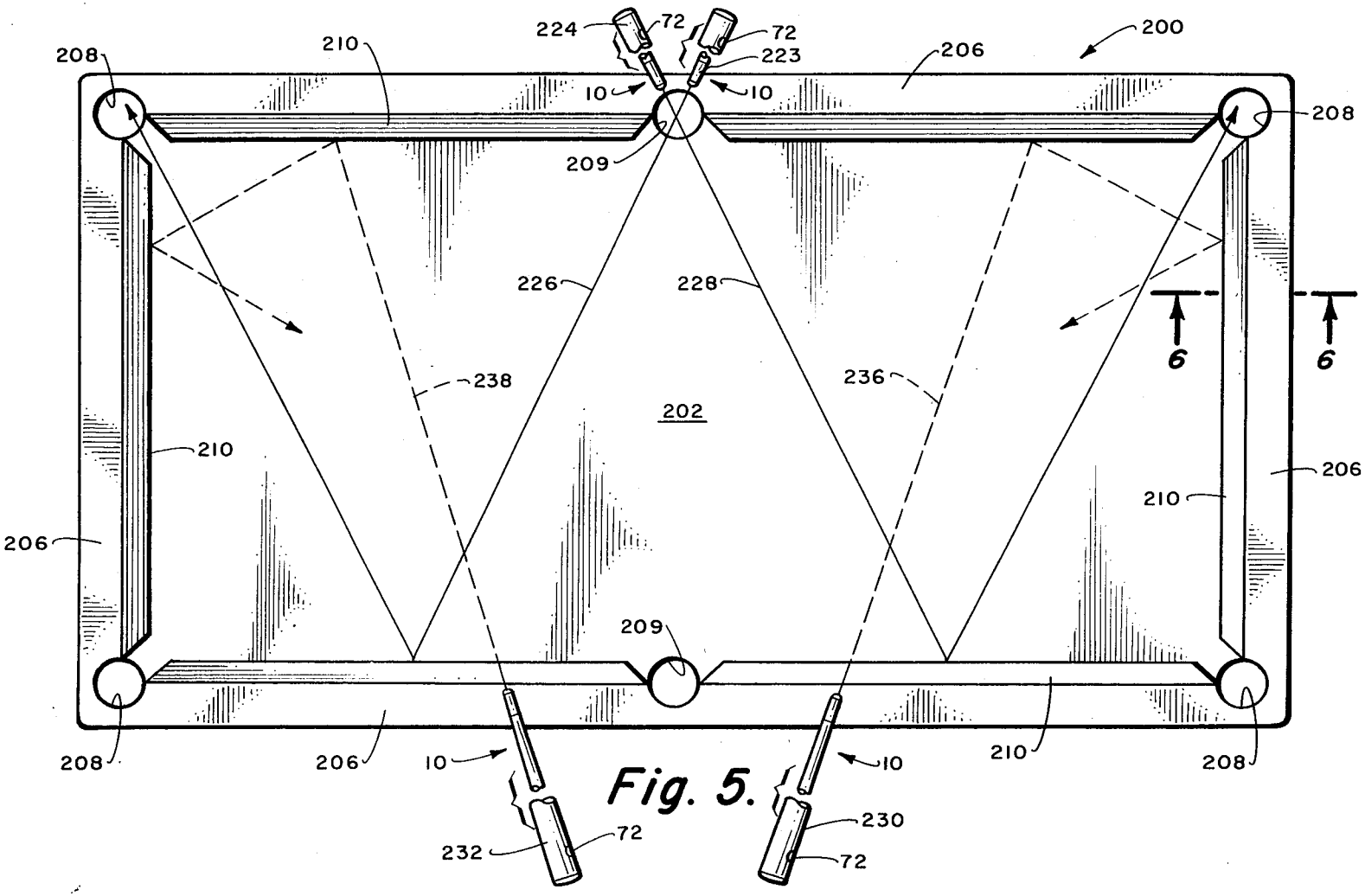
FIG. 5 is a top plan view of a pocket billiard table.

The cue stick 10 can also be utilized in conjunction with reflectorized bumpers as shown in FIGS. 5 and 6. A conventional pool table 200 includes a bed 202 of a hard but somewhat resilient material such as slate or marble in rectangular shape covered by a soft playing surface such as a layer 204 of felt. A raised perimeter is formed by a set of four rails 206. End pockets 208 are provided at the intersections of the side and end rails and side pockets 209 are provided at the midpoints of the side rails. The inner surface of the rails is provided with a set of bumpers 210 in the form of an inwardly facing triangle terminating in an apex 212 forming an overhang 214. The bumpers 210 may also be covered with a layer 216 of felt. A reflector system is formed in accordance with the invention by mounting a vertical reflector or mirror strip 220 within the overhang and beyond the point at which the apex 212 will be compressed during contact with the cue ball or other ball.

The strip 220 may be mounted on a triangular block 222 of resilient material which may be temporarily placed under each overhang 214. The strips may be secured by strips of interlocking fabric such as velcro. Six removable blocks 222 are required in order to form a complete reflectorized system for a pocket billiard table. Only four blocks 222 would be required for a regular billiard table.

Referring now to FIG. 5, the cue stick 10 is placed on the rail 206 and the button 72 is depressed. When the cue is in position 223 or 224, it will project a bank shot 226 or 228 into corner pockets 203. However, when the cue is in position 230 or 232, aiming patterns 236 and 238 will be projected showing that the cue ball will not enter any pocket.

The cue stick of the invention can contain other mechanisms. For example, the tip may contain a laser or other illumination source and the cue stick can have other types of switching mechanisms such as pulse-type or relaytype mechanisms that do not require constant pressure on the switch or button.

Figure 7:
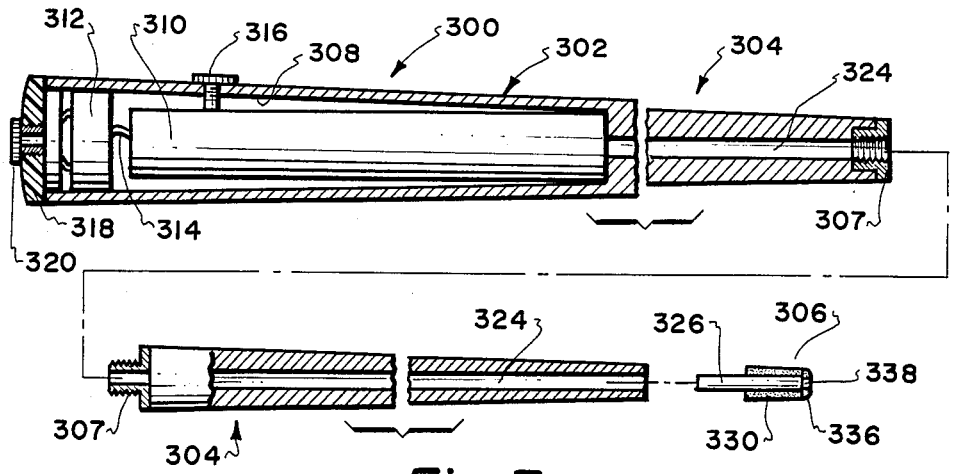
FIG. 7 is a partially sectioned view in elevation of a pool cue in accordance with a second and preferred embodiment of the present invention.
Figure 8:
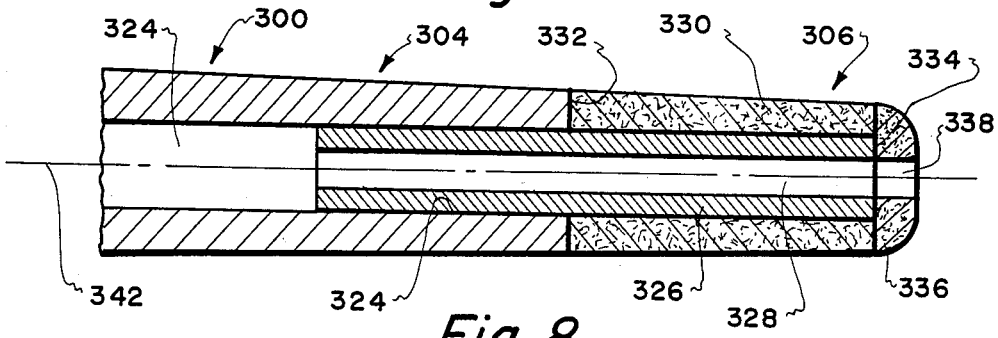
FIG. 8 is an enlarged section view of the tip portion of the embodiment of FIG. 7.
Figure 9:
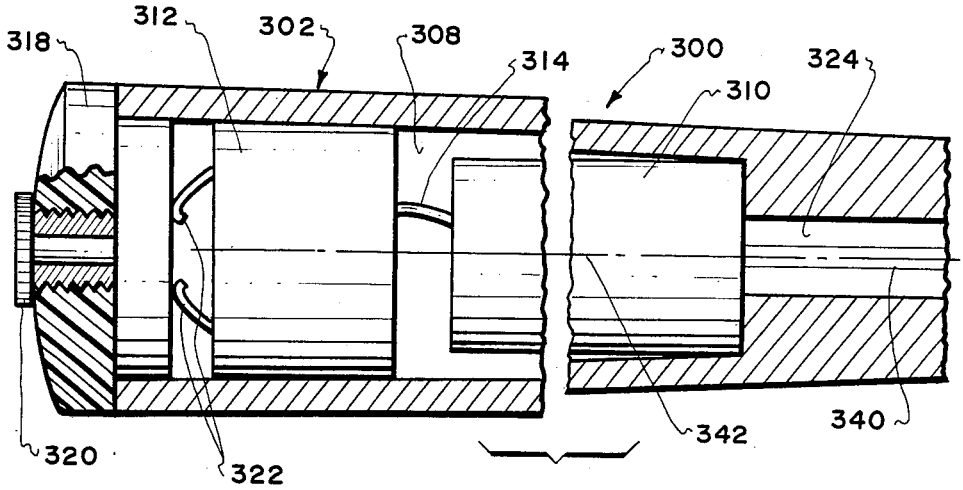
FIG. 9 is an enlarged section view of the handle portion of the embodiment of FIG. 7.

A second embodiment is shown in FIGS. 7–9. In this embodiment, the cue stick, generally indicated as 300, comprises a handle section 302 and a central shaft portion 304 of cylindrical cross-section continuously tapering towards a detachable end section 306. While in the preferred embodiment, the handle section 302 and central shaft portion 304 can be separated at the threaded connector 307 for ease of carrying, they could also be made as a unitary piece with the detachable end section 306 removable therefrom.

The handle section 302 contains a chamber 308 in which is disposed a laser generator 310 of a type generally available in the commercial marketplace. The laser generator 310 is electrically connected to a rechargeable battery 312 by wires 314. A pressure sensitive button 316 is positioned on the outside of the handle section 302 at a position to be contacted by a player's finger or thumb while holding the cue 300 in a normal playing position. The button 316 is, in turn, connected to a switch (not shown) incorporated into the laser generator 310. By depressing the button 316 during game play, a player (or instructor) can cause the laser generator 310 to emit a very narrow and high-intensity collimated beam of light in a manner to be described in greater detail shortly hereinafter. Access to the chamber 308 is provided by a removable plastic butt plate 318. As with the previous embodiment, the balance of the cue 300, with the exception of specific portions of the detachable end section 306 to be described, is optimally formed of aluminum so as to be light weight while, at the same time, resisting warpage which, particularly in this embodiment, could render the aiming system inoperable. A standard plug jack 320 is provided in the butt plate 318 and connected by wires 322 to the rechargeable battery 312. In this manner, a standard source of recharging current terminating in a mating plug can be used to recharge the battery 312 during period of non-play.

A first bore 324 extends longitudinally along the axis of the cue stick 300 between the chamber 308 and the detachable end section 306. As best seen in FIG. 8, the detachable end section 306 comprises a cylindrical metal center sleeve 326 adapted to snugly but removably fit within the first bore 324. Sleeve 326 contains a longitudinal axial second bore 328 therethrough such that when the sleeve 326 is positioned within the first bore 324 as shown in FIG. 8, the bores 324, 328 are in concentric alignment with one another. A cylindrical outer sleeve 330 is positioned around the metal sleeve 326 between the end 332 of the central shaft portion and the outer end 334 of the metal sleeve 326. Sleeve 330 is preferably of a material such as wood, bamboo, or dense fiber such that a standard pool cue tip 336 of resilient material and having an aperture 338 therethrough can be glued to the end of sleeve 330 in the usual manner with the aperture 338 in concentric alignment with the second bore 328. Thus, a resilient tip having normal and expected playing qualities is provided.

Returning now to FIG. 9 with particularity, it can be seen that the laser generator 310 is axially aligned within the chamber 308 such that the laser beam of collimated light 340 therefrom is axially aligned with the bores 324, 328 whereby when the button 316 is depressed and the beam 340 generated by the laser generator 310, it emerges through the aperture 338 along the longitudinal axis 342 of the cue stick 300.

As one important function of this embodiment, the laser generator 310 and rechargeable battery 312 are also used to provide the normal weight and balance for the cue stick 300. By use of the lightweight aluminum and proper choice of the laser generator 310 and rechargeable battery 312 as well as their positioning within chamber 308 along the length of the handle section 302, it was found to be possible to obtain a normal overall weight of 21 ounces and a normal balance point of the cue 300. This is, of course, important in that the primary use of the present invention is as a teaching aid and if the playing characteristics of the pool cue incorporating the aiming light of the present invention are other than normal, the student may find difficulty in playing with a standard cue once having become used to the playing characteristics of the modified cue with the aiming light therein. By providing the normal and usual weight and balance, the transition between the cue incorporating the aiming light of the present invention and a normal pool cue can be made easily and without incident.

It should be understood that only preferred embodiments of the invention have been described herein and that numerous substitutions, modifications, and alterations are possible and permissible without departing from the spirit and scope of the invention as defined in the following claims.

Wherefore, having thus described my invention, I claim:

1. An aiming system for billiards and like games comprising in combination:

(a) a pool cue having a handle section and a central shaft portion of cylindrical cross-section continuously tapering towards a detachable end section, said end section having a first central longitudinal bore therethrough and a resilient tip with an aperture therethrough aligned with said first bore, said cue having a chamber therein and a second central longitudinal bore communicating between said chamber and said end section, said second bore being adapted to receive said end section therein with said first and second bores in axial alignment;

(b) a battery-driven laser source of collimnated light disposed in said chamber and aligned to point a light beam therefrom axially along said first and second bores to emerge through said aperture.

(c) a switch mounted in said handle section so as to be operable while holding said handle section in a game playing position; and, (d) a battery disposed in said chamber and operably wired to said laser light source through said switch whereby during game play a pointing beam of light from said tip can be created by depressing said switch.

2. The aiming system of claim 1 wherein:

said chamber is located within said detachable end section.

3. The aiming system of claim 1 wherein:

said chamber is located within said handle portion.

4. The aiming system of claim 3 wherein:

said laser light source is of a weight and being positioned so as to provide the weight and balance point of said cue in a normal manner.

5. An aiming system according to claim 1, wherein said switch includes: a pressure sensitive portion positioned on said handle section at a location for applying said cue by the shorting hand of a player.

* * * * *